United States Patent [19]

Mirabelli

[11] 4,283,263

[45] Aug. 11, 1981

[54] COVER FOR ELECTROLYTIC CELLS

[75] Inventor: Bruno Mirabelli, Varese, Italy

[73] Assignee: Industrie Pirelli S.p.A., Milan, Italy

[21] Appl. No.: 127,723

[22] Filed: Mar. 6, 1980

[30] Foreign Application Priority Data

Mar. 6, 1979 [IT] Italy ..... 20762 A/79

[51] Int. Cl.[3] ..... C25B 1/40; C25B 9/00

[52] U.S. Cl. ..... 204/219; 204/128; 204/250; 204/279; 204/220

[58] Field of Search ..... 204/128, 219–220, 204/250, 279, 99

[56] References Cited

U.S. PATENT DOCUMENTS

| | | | |
|---|---|---|---|
| 2,998,374 | 8/1961 | Granfors | 204/279 X |
| 3,450,621 | 6/1969 | Anderson | 204/279 X |
| 3,672,973 | 6/1972 | DeNora et al. | 204/279 X |
| 3,794,577 | 2/1974 | Oliver et al. | 204/279 X |
| 4,072,595 | 2/1978 | Chambers et al. | 204/279 X |
| 4,087,343 | 5/1978 | Custer et al. | 204/279 X |
| 4,100,053 | 7/1978 | Anderson | 204/250 X |

*Primary Examiner*—Donald R. Valentine

*Attorney, Agent, or Firm*—Stevens, Davis, Miller & Mosher

[57] ABSTRACT

An electrolytic cell for electrolysis of an aqueous sodium chloride solution is provided with a closure for its open side which is resistant to degradation by chlorine and ozone. The cover has an external elastomeric layer which is stable when exposed to ozone and a polytetrafluoroethylene layer facing the aqueous solution which resists attack by chlorine, and intermediate polyamide, polyester or fiberglass mesh on synthetic rubber layers. The synthetic rubber layer is chloroprene vulcanized with lead oxide.

7 Claims, 2 Drawing Figures

COVER FOR ELECTROLYTIC CELLS

This invention relates to a cover for electrolytic cells for producing chlorine and, more particularly, to a flexible cover for electrolytic cells used for producing chlorine in which the cathode is mercury.

The mercury electrolytic cells for producing chlorine have a tank or container in which there is an aqueous solution of sodium chloride, a cathode which is a layer of mercury lying on the bottom of the cell, and at least one anode which is a bar of electrically conductive material submerged in the aqueous solution and projects above the aqueous solution. The container, moreover, is closed at the top by a cover.

The cathode and the anode are connected to a source of electrical energy and in the cell, during operation, the sodium chloride decomposes with the formation of chlorine at the anode and of sodium at the cathode which reacts with the mercury to form a mercury amalgam.

The presence of the cover permits collection of the chlorine and prevents the escape of chlorine into the atmosphere surrounding the electrolytic cell.

The working conditions of the cell are very severe for the materials constituting it. In fact, the working temperature of the cell is about 100° C., the chlorine is, moreover, a very reactive substance and the reactivity of the forming chlorine is increased by the presence of streams which cannot be avoided owing to the working temperature.

Moreover, since for the electrolysis a high current density is required, ozone is formed outside the cell. Ozone is a highly reactive substance so its release into the air is objectionable. Among the materials forming the electrolytic cell, the cover is stressed the most. Another highly stressed material is that of the anodes of the cell.

Titanium is used for the anodes which solves the problem of extensive wear. Because of the use of titanium for the anodes, the lifetime of the anodes of the newer electrolytic cells is about four years.

The increase of the lifetime of the anodes of the electrolytic cells has made more evident the limited lifetime of the covers closing the cells. In fact, the known covers which are made of elastomeric material have at present a lifetime of only about one year.

The covers are subjected to bad working conditions since, besides corrosion by the chlorine on the surface directed towards the inside of the cell and the corrosion by ozone on their surfaces directed towards the outside of the cell, they are also subjected to mechanical stresses.

These mechanical stresses in the covers of the electrolytic cells are due to the fact that it is necessary to reduce the pressure inside the cell with respect to the surrounding atmosphere so that in case of leaks in the cover, chlorine does not escape. As known, chlorine is a highly poison gas.

This reduced pressure in the cells subjects the cover to mechanical stresses which tend to cause it to buckle inwardly.

The combination of chemical corrosion by chlorine and by ozone in combination with the mechanical stresses and the high working temperature of the cell lead to an unsatisfactory lifetime of the heretofore known covers.

Besides the foregoing disadvantages, there is also the disadvantage that chlorine is so corrosive to elastomeric material that organic substances are formed on the inside cover surface which leads to the formation of a very friable layer and, because of this friability, the layer crumbles and the organic substances pollute the aqueous solution of sodium choride.

Another drawback of the known covers is that because of the mechanical stresses, permanent deformation of the cover occurs with reduction of the space necessary for the discharge of chlorine with accompanying reduction of the electrolytic cell efficiency.

An object of the invention is to provide an improved cover for an electrolytic cell and in particular for an electrolytic cell for producing chlorine which is devoid of the foregoing disadvantages. Another object of the invention is to provide a cover for an electrolytic cell which has an improved useful life and has a useful lifetime at least equal to that of the titanium electrodes which are presently used as anodes, which does not originate organic substances which pollute the sodium chloride solution and does not undergo permanent deformation because of mechanical stress with accompanying reduction of the efficiency of the electrolytic cell. Other objects of the invention will become apparent from the following description with reference to the accompanying drawing.

The foregoing objects and others are accomplished in accordance with the present invention by providing a cover for electrolytic cells used for producing chlorine, characterized by the fact of comprising a plate of elastomeric material embedding a tension resistant insertion, where the surface of the plate turned toward the inside of the cell is covered with a layer of flexible material capable of resisting chemical attack by chlorine.

DESCRIPTION OF THE INVENTION

Figure 1:
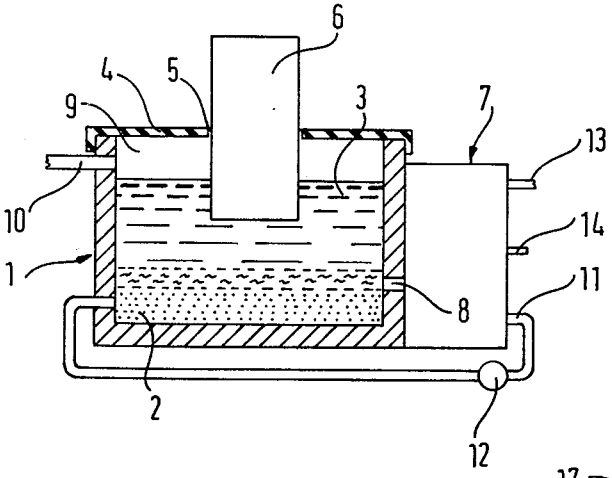
FIG. 1 shows schematically and in section an electrolytic cell for producing chlorine provided with one embodiment of a cover provided by the invention.

As shown in FIG. 1, the electrolytic cell has a container or tank 1 provided on the bottom with a layer 2 of mercury which is the cathode of the cell. An aqueous solution 3 of sodium chloride is present on the mercury layer. The container 1 is closed by a cover 4 having the structure shown in FIG. 2, which will be better described later on. The cover 4 is provided with an opening 5 through which a titanium member 6 passes with one of its ends disposed in the solution 3. Member 6 is the anode of the cell and is provided with means, not shown, through which it is possible to submerge more of body 6 in the solution in container 1.

Near the container 1 there is a device for decomposing the amalgam schematically illustrated as a container 7 in communication with the container 1 through an opening 8 in the wall separating the two containers 1 and 7.

In the container 7, there are mercury and water which are placed in contact with each other on a catalytic mass, not shown. During the working of the electrolytic cell briefly described above, the following occurs:

The sodium chloride present in the solution 3 is ionized and chlorine develops around the anode 6 and fills the space 9 between the cover 4 and the surface of solution 3.

Chlorine present in the space 9 is continuously removed through duct 10 by means of a pump, not shown, which originates in space 9, a depression. In cover 4 are concentrated mechanical stresses which tend to bend the cover 4 towards the inside of the cell.

While the above indicated phenomenon takes place, sodium migrates towards the layer of mercury 2 forming an amalgam.

Through the opening 8 in the wall of the container 1 which separates container 1 from container 7 the amalgam passes into container 7 where the contact between the amalgam and the water takes place. The amalgam of mercury reacts with water in contact therewith to form sodium hydroxide, release mercury and form hydrogen.

The mercury released during this reaction is recycled by means of a pump 12 into container 1.

The hydrogen is removed from duct 13, while the solution of sodium hydroxide is driven away from container 7 through the duct 14.

As stated above, container 1 is closed by the cover 4.

In its more general aspects, cover 4 has a plate of elastomeric material with a tension resistant insert embedded therein. The surface of cover 4 directed towards the inside of the cell is covered with a layer of flexible material which is resistant to attack by chlorine.

Figure 2:
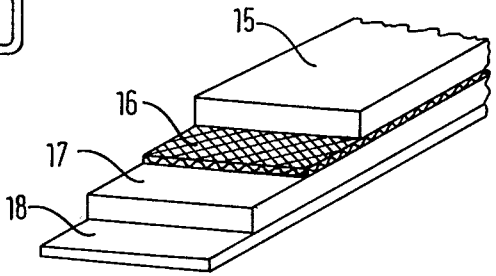
FIG. 2 shows in a pespective view and on an enlarged scale a portion of an embodiment of a cover provided by the invention with parts partially broken away to better illustrate the structure.

Referring now to FIG. 2, the structure of the cover provided for electrolytic cells by the invention, starting from the surface turned to the outside of the cell and moving towards the surface turned to the inside of the cell, is the following:

A layer 15 of elastomeric material which is resistant to the chemical action of ozone and, in particular, is resistant to chemical action of ozone at high temperature and is stable at a high temperature forms the external part of the cover.

A tension resistant structure 16 formed from a mesh or a square fabric selected from glass fibers, polyammide, polyester and the like is disposed on the inside of layer 15. If a polyamide or polyester is used, the structure is treated with a solution which improves the adhesion thereof to the elastomeric layer 15, and i.e., solutions of synthetic latices containing isocyanates or phenolic resins.

Under the tension resistant structure 16 there is a layer 17 of a compound of elastomeric material based on chloroprene vulcanized with lead oxide.

Under the layer 17, there is a layer 18 of polytetrafluoroethylene which is chemically inert to chlorine action and in particular to the action of freshly formed chlorine in the presence of moisture.

From experimental tests made on covers made in accordance with the present invention, it has been displayed that although the results obtained are satisfactory regardless of the thickness of the layers, covers having the longest lifetime have been made with the following thicknesses of the layers in question and the following chemical-physical characteristics of the layers:

The thickness of layer 15 directed towards the outside of the cell should be 1.5 to 2 mm; the hardness should be between 60° and 70° Shore A and layer 15 should be made from a compound based on butyl or chlorobutyl and polyethylene-propylene.

If for the formation of the layer 15, a compound based on chlorobutyl is used, its composition should be

| | |
|---|---|
| chlorobutyl | 100 parts by weight |
| vulcanizing agents | 6 parts by weight |
| zinc oxide | 5 parts by weight |
| antioxidizers | 2 parts by weight |
| plasticizers | 10 parts by weight |
| carbon black | 30 parts by weight |
| mineral fillers | 20 parts by weight |

This elastomeric composition has a hardness of 70° Shore A, a tensile strength higher than 100 kg/cm$^2$ and an ultimate elongation higher than 300%.

The characteristics determined from experimental tests as those required for a cover to have a long lifetime are a tension resistant insert mesh or square fabric 16, having a tensile strength higher than 125–250 kg/5 cm; an ultimate elongation not higher than 3% if glass fibers are used, and about 20% if polyamide in association with a weight between 140 and 180 grams/m$^2$ is used.

The characteristics for the layer 17 of the cover required to obtain the best lifetime of the cover are a thickness of about 2 mm and a hardness between 60° and 80° Shore A. Neoprene vulcanized with lead oxide provides these properties.

A composition suitable for the formation of this layer 17 has the following formula:

| | |
|---|---|
| chloroprene | 100 parts by weight |
| vulcanizing agents | 22 parts by weight |
| antioxidants | 2 parts by weight |
| plasticizers | 10 parts by weight |
| mineral fillers | 40 parts by weight |

This elastomeric composition provides a composition with the following physical properties: hardness of 65° Shore A, a tensile strength of 130 kg/cmq and an ultimate elongation higher than 500%.

The layer 18 which is the innermost layer directed towards the inside of the cell, is polytetrafluoroethylene. This layer has a thickness of between 0.10 and 0.20 mm. The layer 18 moreover is joined to the layer 17 by means of a conventional adhesive for bonding polytetrafluoroethylene to the elastomeric material of layer 17.

As stated above, by means of a cover for electrolytic cells according to the present invention it is possible to extend the useful life of the cover for a period which is at least equal to the useful life of the titanium anodes, to avoid the formation of organic substances which pollute the electrolytic solution and to avoid practically permanent deformations of the cover with the consequent reduction of the efficiency of the electrolytic cell making use of the covers.

The explanation of the way in which the above indicated advantages are achieved by means of a cover according to the present invention, can be deduced by the following considerations.

The presence of a thin layer of polytetrafluyoroethylene on the cover surface of elastomeric material directed towards the inside of the cell prevents chlorine from reacting with the elastomeric material of the cover and therefore prevents corrosions in the latter.

Moreover, even if for any reason chlorine contacts the elastomeric material of the cover, and in particular with the layer 17 lying immediately over the layer of polytetrafluoroethylene, the reactions between the chlorine and the elastomeric material do not produce chlorinated fragile organic substances and therefore substances which can easily crumble because lead oxide is used as the vulcanizing agent.

The polytetrafluoroethylene layer which covers entirely the surface facing the inside of the cell prevents chlorinated substances which are eventually formed from falling into the cell and polluting the aqueous solution.

Also, the combination due to the presence of the polytetrafluoroethylene layer and of a resistant structure formed by a mesh or tape of flexible and inextensible material placed at a certain distance from each other, allowing the formation of a double layer in association with the very good characteristics of mechanical resistance of said polytetrafluoroethylene at high temperature, improves the bending mechanical resistance of the cover and therefore reduces the danger of permanent deformations of the cover.

Although a preferred embodiment of the invention has been illustrated and described, it is to be understood that such detail is solely for illustration and that the invention contemplates modifications therein except as the invention may be limited by the claims.

What is claimed:

1. A cover for an electrolytic cell for producing chlorine comprising a laminated plate, a tension resistent insert member imbedded in the laminated plate, said laminated plate consisting essentially of overlapping sheets firmly joined face to face to each other, that sheet of the laminated plate which has a surface exposed outwardly of the cell being an elastomeric composition which is resistent to heat and ozone and the surface of the plate facing the inside of the cell being neoprene vulcanized with lead oxide.

2. The cover of claim 1, characterized by the fact that the tension resistant insert is arranged between the sheet of elastomeric composition which is resistant to heat and to ozone, and a sheet of chloroprene vulcanized with lead oxides.

3. The cover of claim 2, characterized by the fact that the tension resistant insert is a mesh of glass fiber.

4. The cover of claim 2, characterized by the fact that the tension resistant insert is a square fabric of nylon or the like treated with an adhesive.

5. The cover of claim 2, characterized by the fact that the tension resistant insert is a square fabric of polyester treated with an adhesive.

6. A cover for an electrolytic cell for producing chlorine having a bottom, sidewalls and an open top, a mercury cathode and a titanium anode, said cover being a laminated structure adapted to close the open side and comprising from its exposed surface to its surface facing the inside of the cell, a first layer of an elastomer, a hardness of Shore A 60°-70°, a polyamide, polyester or glass fiber mesh disposed against the said first layer and having a tensile strength of more than 250 k/5 cm., a layer of chloroprene rubber vulcanized with lead oxide, and a layer of polytetrafluoroethylene facing the inside of the cell.

7. In an electrolytic cell for producing chlorine having an open sided tank, a cover for closing said open side comprising a first externally exposed layer of an elastomeric composition which is resistant to ozone and has a Shore A hardness of 60°-70°, a tension resistant mesh fabric disposed next to the said first layer and having a tensile strength of more than 250 kg/5 cm. disposed against the inner face of said first layer, a layer of vulcanized chloroprene synthetic rubber having a hardness of Shore a 60°-80° disposed against the mesh, and facing the contents of the cell a layer of polyetrafluoroethylene, said cover having an opening therethrough for insertion of an anode.

* * * * *